US005911100A

United States Patent [19]

Hasegawa et al.

[11] Patent Number: 5,911,100

[45] Date of Patent: Jun. 8, 1999

[54] IMAGE FORMING APPARATUS HAVING TRANSFER DRUM WITH PEELING MEMBER

[75] Inventors: Takashi Hasegawa, Ageo; Yoichi Kimura, Kawaguchi; Satoshi Tamura, Yokohama, all of Japan

[73] Assignee: Canon Kabushiki Kaisha, Tokyo, Japan

[21] Appl. No.: 08/795,722

[22] Filed: Feb. 4, 1997

Related U.S. Application Data

[63] Continuation of application No. 08/408,280, Mar. 22, 1995, abandoned.

[30] Foreign Application Priority Data

Mar. 25, 1994 [JP] Japan ..... 6-055731

[51] Int. Cl.[6] ..... G03G 15/01

[52] U.S. Cl. ..... 399/303; 271/900

[58] Field of Search ..... 271/900; 399/398, 399/399, 303, 323, 305, 312

[56] References Cited

U.S. PATENT DOCUMENTS

| | | | |
|---|---|---|---|
| 4,000,942 | 1/1977 | Ito et al. | 355/315 |
| 4,223,993 | 9/1980 | Tsuda et al. | 355/315 |
| 4,806,985 | 2/1989 | Foley et al. | 271/900 X |
| 4,893,146 | 1/1990 | Tachibana et al. | 355/315 |
| 5,083,167 | 1/1992 | Fukushima et al. | 355/274 |
| 5,125,644 | 6/1992 | Masaki et al. | 271/900 X |
| 5,130,758 | 7/1992 | Takeda et al. | 355/315 |
| 5,617,197 | 4/1997 | Kawabata et al. | 399/398 |

FOREIGN PATENT DOCUMENTS

| | | | |
|---|---|---|---|
| 61-290464 | 12/1986 | Japan | 355/315 |
| 3-231279 | 10/1991 | Japan | 355/315 |
| 6-180538 | 6/1994 | Japan | 355/315 |

*Primary Examiner*—Robert Beatty
*Attorney, Agent, or Firm*—Fitzpatrick, Cella, Harper & Scinto

[57] ABSTRACT

An image forming apparatus includes a movable member carrying a recording sheet bearing a non-fixed image and a separation device for separating the recording sheet from the movable member. The separation device includes a peel member made from resin and having a resistance between $10^3$ and $10^{11}$ Ω) and an electricity removing charger. The peel member is supported by a support member and is positioned such that a part of the resin peel member is within the discharge area of the electricity removing charger and the support member is disposed outside the discharge area and is electrically grounded.

11 Claims, 6 Drawing Sheets

FIG. 4

| PAWL MATERIAL | WIDTH (mm) | IMAGE QUALITY | SEPARABILITY | STRENGTH |
|---|---|---|---|---|
| METAL (IRON) | 1 | × | × | ○ |
| | 2.5 | × | ○ | ○ |
| RESIN (PP) | 1 | × | × | × |
| | 2.5 | × | ○ | ○ |
| METAL PLUS FLUORIDE COAT | 1 | ○→× | × | ○ |
| | 2.5 | ○→× | ○ | ○ |
| RESIN OF RESISTANCE VALUE $10^7\Omega$ | 1 | ○ | × | × |
| | 2.5 | ○ | ○ | ○ |

IMAGE FORMING APPARATUS HAVING TRANSFER DRUM WITH PEELING MEMBER

This application is a continuation of application Ser. No. 08/408,280, filed Mar. 22, 1995, now abandoned.

BACKGROUND OF THE INVENTION

1. Field of the Invention

The present invention relates to an image forming apparatus having a separating means for separating a recording sheet from a movable member, and more particularly, it relates to an image forming apparatus for forming an image on a recording sheet by transferring a toner image formed on an image bearing member onto a recording sheet supported by a movable member.

2. Related Background Art

There have been proposed color image forming apparatuses wherein a color image can be obtained by successively transferring different color toner images formed on a photosensitive drum onto a recording sheet supported by a transfer drum in a superimposed fashion. In such image forming apparatuses, a separation pawl interposed between the transfer drum and the recording sheet to separate the recording sheet from the transfer drum is made of metal, for example, iron.

However, when the separation pawl earthed is made of metal, since ions generated by peeling discharge between the recording sheet and the transfer drum are concentrated into an area where the metal pawl is positioned, there is a danger of distorting the non-fixed toner images transferred to the recording sheet. On the other hand, if the separation pawl is made of insulation resin, there arises risk that the non-fixed toner images transferred to the recording sheet are distorted due to friction charge between the separation pawl and the recording sheet.

Further, if the separation pawl is constituted by a metal pawl which is earthed, and a coating layer (coated on the metal pawl) made of insulation resin of fluoro-group, initially, the recording sheets can be separated from the transfer drum. However, in this case, a thickness of the coating layer of the insulation resin of fluoro-group must be reduced to prevent the friction charge between the recording sheet and the resin of fluoro-group (500 $\mu$m or less). Therefore, as the number of copies is increased, the coating layer is worn, thereby causing the same problem as the metal pawl.

SUMMARY OF THE INVENTION

An object of the present invention is to provide an image forming apparatus having a separation means for separating a recording sheet from a movable member without distorting non-fixed toner image(s) transferred to a recording sheet.

Another object of the present invention is to provide an image forming apparatus including a separation means for effectively separating a recording sheet from a movable member high volume resistance.

The other objects and features of the present invention will be apparent from the following detailed description of the present invention explained with reference to the accompanying drawings.

BRIEF DESCRIPTION OF THE DRAWINGS

FIG. 4 is a table showing image quality, separability and strength regarding various pawl materials;

DETAILED DESCRIPTION OF THE PREFERRED EMBODIMENTS

An image forming apparatus according to an embodiment of the present invention will now be explained with reference to the accompanying drawings.

After a photosensitive drum (image bearing member) 1 is uniformly charged by a charger, light corresponding to image information is illuminated onto the photosensitive drum, thereby forming an electrostatic latent image on the drum. Then, the latent image is developed by toner from a developing means as a toner image. The toner image formed on the photosensitive drum 1 is transferred onto a recording sheet (for example, paper sheet) P supported by a transfer drum 5*a*. The above-mentioned image forming process is repeated with respect to magenta toner, cyan toner, yellow toner and black toner, respectively, so that the four different color toner images are successively transferred onto the recording sheet P in a superimposed fashion. Thereafter, the recording sheet P is separated from the transfer drum 5*a*, and the separated recording sheet is sent to a fixing device, where the four different color toner images are fused and mixed to obtain a full color image.

Next, a transfer device having the transfer drum will be fully explained.

Figure 1:
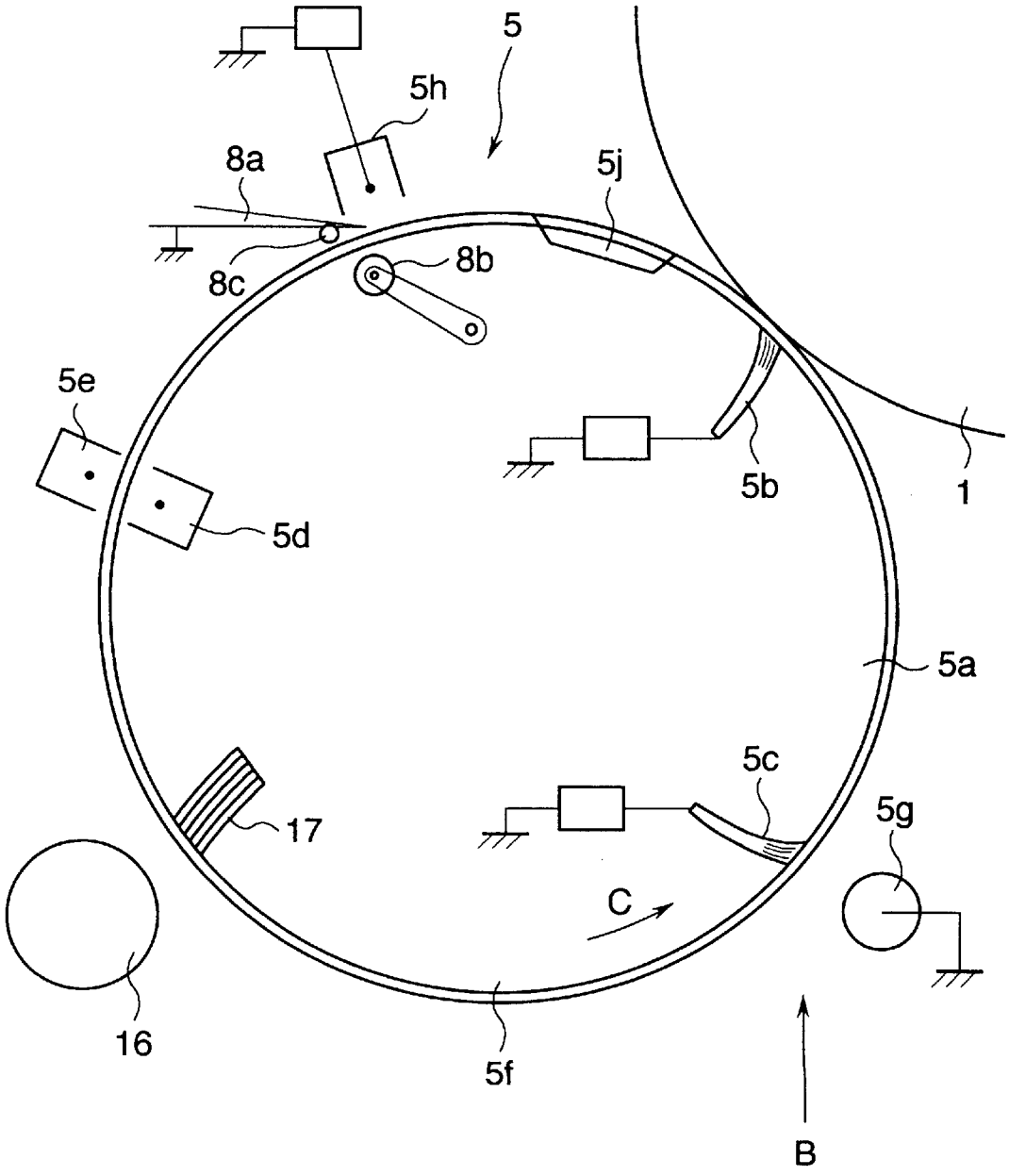
FIG. 1 is a sectional view of a transfer drum (5*a*) and therearound for explaining an embodiment of the present invention.

In FIG. 1, a transfer sheet (recording sheet bearing member) 5*f* for electrostatically absorbing the recording sheet and for conveying the recording sheet in a direction shown by the arrow C is wound around a peripheral surface of the transfer drum 5*a* in such a manner that tip and rear ends of the transfer sheet 5*f* are adhered to a connecting member 5*j* of the transfer drum 5*a*. In the illustrated embodiment, the transfer sheet 5*f* is formed from a flexible PC (polycarbonate) film having a thickness of 150 $\mu$m and a volume resistance of $10^{15}$ Ωcm or more, because an absorbing force for absorbing the recording sheet to the transfer sheet 5*f* is improved by using the dielectric film having high volume resistance as the transfer sheet. Accordingly, it is possible to use a thick sheet as the recording sheet and to increase a process speed by increasing a rotational speed of the transfer drum 5*a*.

The recording sheet P is supplied by a sheet supply means (not shown) from a direction shown by the arrow B. An absorb roller 5*g* is contacted with the transfer sheet 5*f* by a drive source (not shown) and absorb current (charge) is applied by an absorb charge brush 5*c*. Since the absorb roller 5*g* is electrically earthed, current (charge) having polarity opposite to that of the current (charge) applied by the absorb charge brush 5*c* is induced on the absorb roller, thereby electrostatically absorbing the recording sheet P to the transfer sheet 5*f*.

Then, current (charge) is applied from a positive high voltage source to a transfer brush 5*b* so that the toner image charge negatively is transferred from the photosensitive drum 1 onto the recording sheet as mentioned above. In the multi-transferring, the above transferring operation is repeated by desired times.

Figure 5:
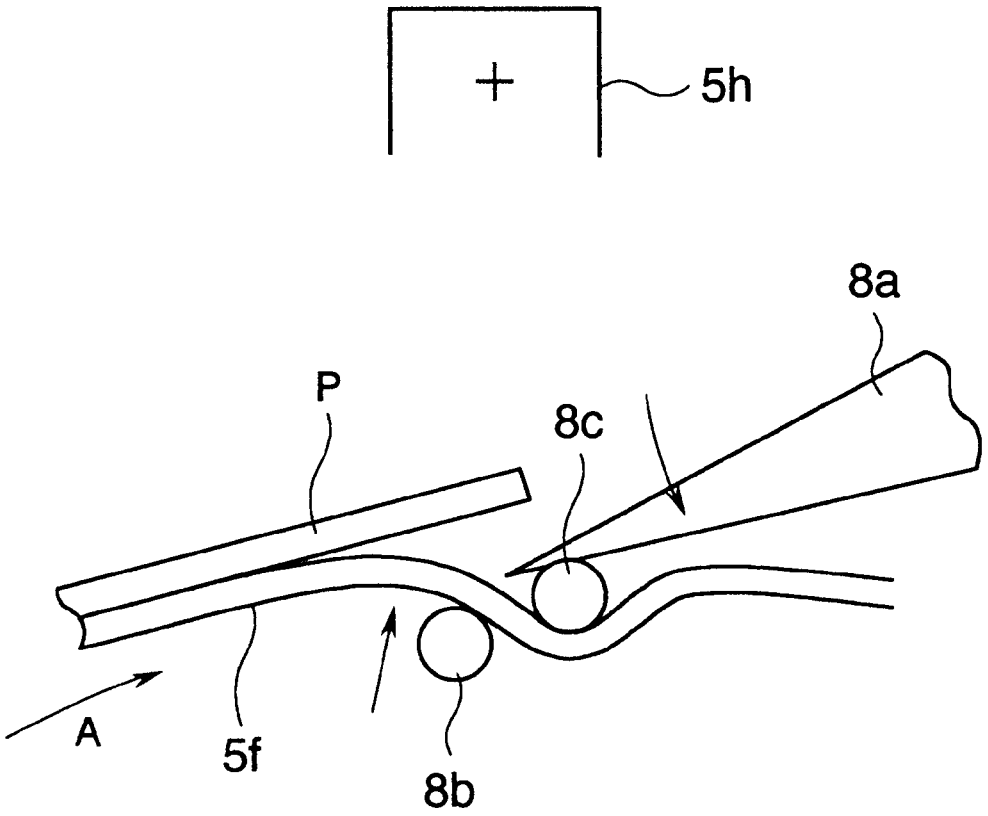
FIG. 5 is an explanatory view for explaining the recording sheet.

After the transferring operations are finished, the recording sheet is moved in a direction shown by the arrow A. When the recording sheet approaches an urging roller 8*b*, the urging roller 8*b* is driven by a drive means, thereby pushing up the transfer sheet 5*f* toward a separation pawl (separation member) 8*a* as shown in FIG. 5. In synchronous with this operation, the separation pawl 8*a* is operated by a drive means to be lowered toward the transfer sheet 5*f* as shown in FIG. 5. In this case, a separation pawl roller 8*c* is contacted with the transfer sheet 5*f* to prevent the transfer sheet from being damaged by a tip end of the separation pawl 8*a*. That is, as shown in FIG. 5, the transfer sheet 5*f* is deformed by the urging roller 8*b* so that a tip end of the recording sheet is peeled from the transfer sheet 5*f*. Then, when the recording sheet is shifted toward the separation pawl 8*a*, the recording sheet is separated from the transfer sheet by the separation pawl.

On the other hand, a separation electricity removal charger 5*h* shown in FIGS. 1 and 5 performs discharging operation during the recording sheet separating operation to assist the separation of the recording sheet and to neutralize ions generated due to peel discharge between the recording sheet P and the transfer sheet 5*f*, thereby preventing occurrence of uneven discharge.

After the separating operation is finished, a transfer sheet cleaner 16 is rotated by a drive motor (not shown) and is urged against the transfer sheet 5*f* by a drive means, so that the cleaner cooperates with a back-up brush 17 opposed to the cleaner 16 with the interposition of the transfer sheet 5*f* to remove the residual toner from the transfer sheet 5*f*. Further, an inner and outer electricity removal chargers 5*d*, 5*e* are operated before and after the series of absorbing, transferring and separation operations to electrically initialize the transfer sheet 5*f*.

Next, concrete values of various elements are shown.

A diameter of the transfer drum 5*a* is 180 mm and a moving speed of the transfer drum is 130 mm/sec. Further, (i) Current of absorb brush $I^Q$=15 $\mu$A (ii) Current of transfer brush $I^T$=10 $\mu$A (iii) Output of separation electricity removal charger
AC V=12 kvpp
DC $I_s$=300 $\mu$A
(if necessary)

(iv) Output of inner electricity removal charger
AC V=12 kVpp . . . (a)
DC $I_i$=−200 $\mu$A (v) Output of outer electricity removal charger
AC V=12 kVpp . . . (b)
DC $I_o$=200 $\mu$A Incidentally, the above (a) and (b) are sine waves having opposite phases.

Figure 7:
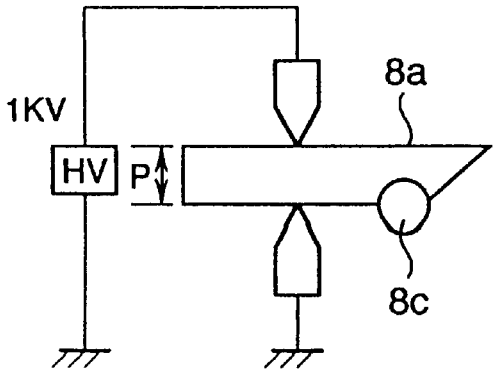
FIG. 7 is a schematic view showing a means for measuring a resistance value of the separation pawl.

The separation pawl 8*a* is made of polyester including dispersed carbon and having resistance of about $10^7$ Ω. The resistance value of the separation pawl 8*a* was measured by applying voltage of 1 KV to the pawl having a thickness (d) of 6 mm, as shown in FIG. 7.

Figure 6A:
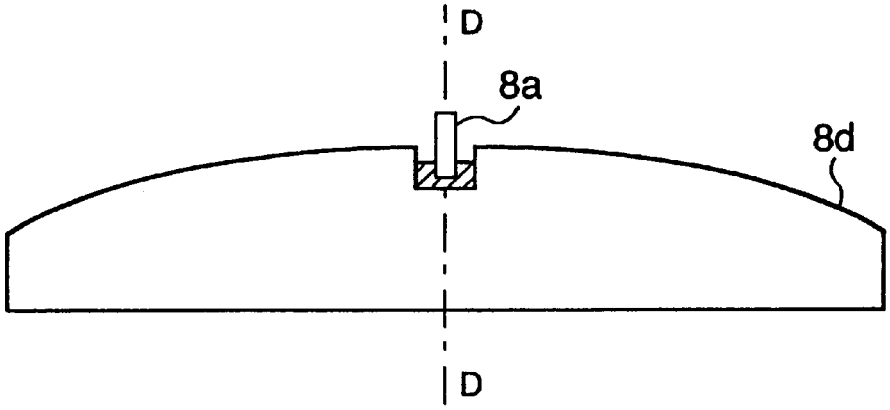
FIGS. 6A and 6B are views showing a recording sheet separation means.
Figure 6B:
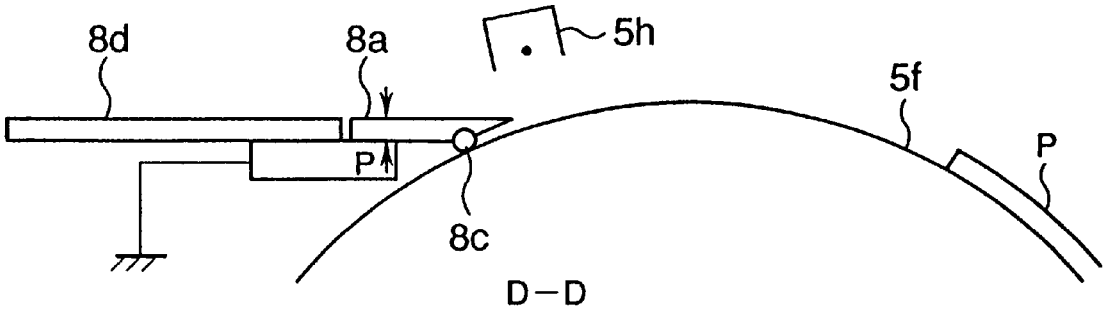

Further, as shown in FIGS. 6A and 6B, the separation pawl 8*a* is supported by a separation assist wing 8*d* for supporting the separation pawl 8*a* and for directing the recording sheet separated by the separation pawl toward the fixing device. The separation assist wing 8*d* is formed from iron coated for UV protection, if possible, grounded and is electrically. Incidentally, the separation pawl 8*a* may be made of polyamide having resistance of $10^3$ to $10^{11}$ Ω.

(Test 1)

The function of the separation pawl is to stably separate the recording sheet from the transfer drum 5*a*. Strictly speaking, the following three factors must be ensured; that is, (i) predetermined recording sheets should be stably separated (separability), (ii) the toner images on the recording sheet should not be distorted during the separating operation (image quality), and (iii) the separation pawl should not be damaged if the sheet jam occurs during the separating operation (strength).

In this test 1, in addition to the earthed separation pawl 8*a* made of resin having resistance of $10^7$ Ω, as comparison examples, earthed metal Iron, earthed resin and earthed metal with fluoride coat were also used as separation pawls, respectively, to determine good (O) or bad (x) regarding the above three factors. The results are shown in FIG. 4.

Regarding the separability (i), recording sheets P having weights of 64, 80, 105, 128 and 157 gr/m$^2$ were used, respectively (in this case, if the poor separation occurred regarding even one sheet, the result was judged as bad (x)). In FIG. 4, regarding the recording sheet having weight of 64 gr/m$^2$, the poor separation occurred. It was found that this phenomenon occurs because (although the tip end of the recording sheet could be separated) the separation pawl was penetrated into the recording sheet during the movement of the separated sheet (particularly, recording sheet having a large size, for example, A3 size).

Figure 2:
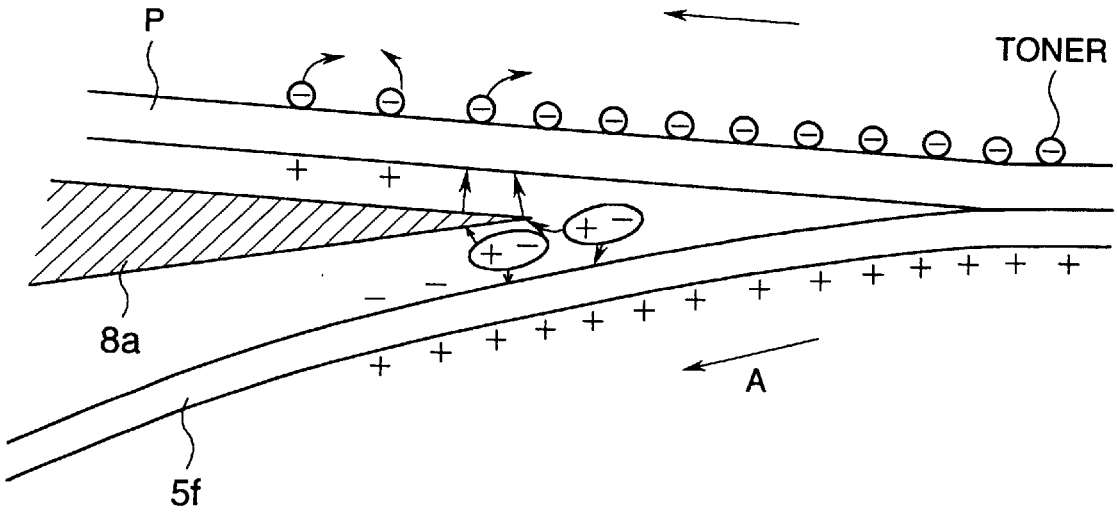
FIG. 2 is an enlarged view showing a charged condition in a recording sheet peeled area, generated when a separation pawl is made of metal.
Figure 3:
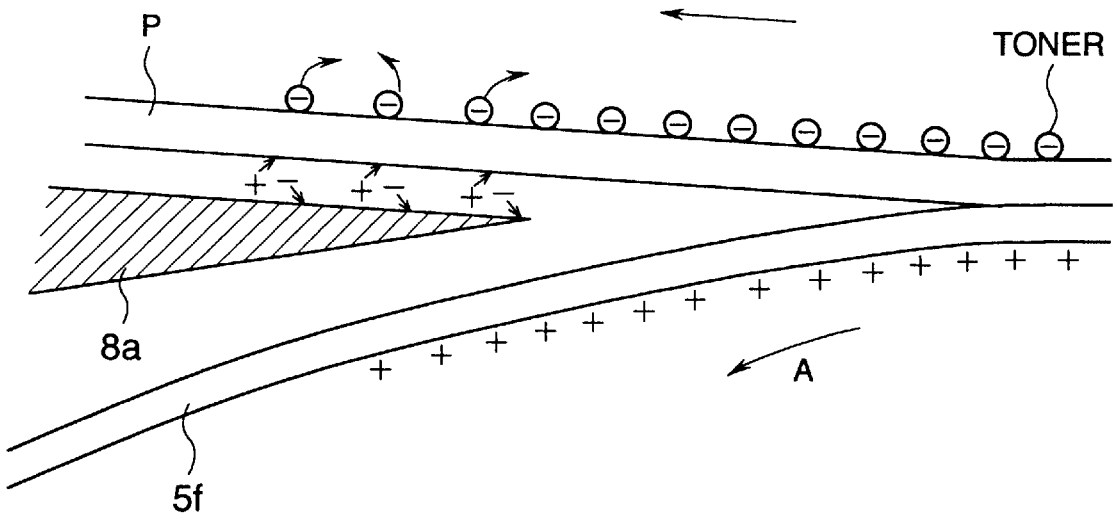
FIG. 3 is an enlarged view showing a charged condition in a recording sheet peeled area, generated when a separation pawl is made of insulation resin.

Regarding the image quality (ii), toner scattering was checked at a position where the separation pawl 8*a* is disposed. When the separation pawl is formed from the earthed metal, a white stripe was generated at that position. The reason is that, as shown in FIG. 2, the ions generated due to the peel discharge between the recording sheet P and the transfer sheet 5*f* are concentrated onto the separation pawl 8*a* and the toner image on the sheet P is distorted by the ions. Further, since the charges generated due to the corona discharge from the separation electricity removal charger 5*h* are concentrated into the position where the separation pawl 8*a* is disposed, the image at that position is distorted. On the other hand, when the separation pawl is formed from the insulation resin, the arrangement of toner at a position where the pawl is disposed was delicately changed to generate a stripe pattern. The reason is that, as shown in FIG. 3, the non-fixed toner image on the recording sheet P is distorted by the friction charge between the pawl 8*a* and the recording sheet P. When the separation pawl is formed from metal with insulation fluoride coat, although the good result was obtained in the initial period, after about 500 sheets were copied, the fluoride coat was worn by the recording sheets P, the same problem as the metal separation pawl occurred.

The thickness of the fluoride coat must be reduced (less than 500 $\mu$m) to prevent the distortion of the non-fixed image due to the friction charge between the separation pawl 8*a* and the recording sheet P. When the transfer sheet 5*f* having high volume resistance (more than $10^{15}$ Ωcm) is used as is in the illustrated embodiment, since the absorbing force between the transfer sheet 5*f* and the recording sheet P is great, the wear of the coating due to the contact between the coating and the recording sheet is also great.

However, according to the illustrated embodiment, since the thickness P (in FIG. 6) of the separation pawl 8*a* made of resin having resistance of $10^7$ Ωis 3 mm or more and the entire separation pawl is formed from the resin having the resistance of $10^7$ Ω, even when a large number of recording sheets are treated, the non-fixed toner image on the recording sheet P is not distorted.

Regarding the strength (ii), the poor separation of the thick sheet (having a weight of 157 gr/$m^2$) was forcibly occurred at the separation pawl 8*a* and damage of the pawl 8*a* was checked. When a width of the tip end of the separation pawl 8*a* in a direction (axial direction of the transfer drum 5*a*) perpendicular to the moving direction of the recording sheet P was 1 mm and the separation pawl was made of insulation resin, the separation pawl 8*a* was damaged by the resiliency of the recording sheet P. Similarly, when a separation pawl having a width of 1 mm and made of resin having resistance of $10^7$ Ω was used, this pawl was also damaged by the resiliency of the recording sheet P.

On the other hand, when the separation pawl was made of metal, the transfer sheet 5*f* was damaged when the transfer sheet is contacted with the separation pawl 8*a*.

(Test 2)

The image quality was checked by changing the resistance value of the earthed separation pawl by varying an amount of carbon dispersed in the polyester resin. To this end, five kinds of separation pawls having resistance values of $10^3$, $10^6$, $10^9$, $10^{11}$ and $10^{13}$ Ωwere prepared.

Each separation pawl had a configuration as shown in FIGS. 6A and 6B and the resistance values were measured at a position where the thickness P is 6 mm in the manner as shown in FIG. 7.

As a result, although the separation pawls having resistance values of $10^3$, $10^6$, $10^9$, and $10^{11}$ Ωachieved good result as is in the separation pawl having resistance of $10^7$ Ω(test 1), the separation pawl having resistance of $10^{13}$ Ω created a stripe pattern as is in the insulation resin pawl (test 1).

(Conclusion)

From the test result, the separation pawl 8*a* formed from earthed resin having resistance value of $10^3$ to $10^{11}$ Ω is optimum for the image quality. However, in order to obtain this resistance value, since conductive filler such as carbon is normally dispersed in the plastic, it is preferable that a width of the separation pawl 8*a* in a direction perpendicular to the moving direction of the recording sheet is 2 mm or more to ensure the strength and separability of the separation pawl.

What is claimed is:

1. An image forming apparatus, comprising:

a movable member for bearing and conveying a recording sheet, the recording sheet having a first surface bearing a non-fixed image and a second surface opposite to the first surface;

image forming means for forming an image onto the recording sheet born on said movable member; and separation means for separating the recording sheet bearing the non-fixed image on the first surface from said movable member, said separation means having an electricity removing charger for removing electricity from the recording sheet, a peel member being opposite to said electricity removing charger and being inserted between said movable member and the second surface of the recording sheet and having a resistance of $10^3$ to $10^{11}$ Ω, and a support member for supporting said peel member, wherein a part of said peel member within a discharging area of said electricity removing charger consists of only a resin, and said support member is disposed outside the discharging area of said electricity removing charger and electrically grounded.

2. An image forming apparatus according to claim 1, wherein said movable member electrostatically supports and conveys the recording sheet.

3. An image forming apparatus according to claim 2, said image forming means comprising an image bearing member for bearing an image, and a transfer charger for transferring the image on said image bearing member onto the recording sheet supported by said movable member.

4. An image forming apparatus according to claim 2 or 3, wherein said movable member includes a dielectric film having volume resistance of at least $10^{15}$ Ωcm.

5. An image forming apparatus according to claim 1, further comprising an urging member for urging and deforming said movable member, when the recording sheet is separated from said movable member.

6. An image forming apparatus according to claim 1, wherein a width of said peel member in a direction perpendicular to a shifting direction of said movable member is at least 2 mm or more.

7. An image forming apparatus according to claim 1 or 6, wherein said peel member includes a portion having a thickness of at least 3 mm in a direction perpendicular to a plane of said peel member contacting with the recording member.

8. An image forming apparatus according to claim 3, wherein said image bearing member bears a plurality of images to be successively transferred onto the recording sheet supported by said movable member in a superimposed fashion.

9. An image forming apparatus according to claim 1, wherein said peel member is formed from polyester resin including dispersed carbon.

10. An image forming apparatus according to claim 1 or 5, further comprising a press member provided on the peel member for pressing and deforming said movable member, when the recording sheet is separated from said movable member.

11. An image forming apparatus according to claim 1, wherein the resin has conductive filler dispersed therein.

* * * * *

UNITED STATES PATENT AND TRADEMARK OFFICE

CERTIFICATE OF CORRECTION

PATENT NO. : 5,911,100

DATED : June 8, 1999

INVENTOR(S) : TAKASHI HASEGAWA, ET AL.

It is certified that error appears in the above-identified patent and that said Letters Patent is hereby corrected as shown below:

COVER PAGE AT ITEM [57] ABSTRACT,
Line 7, "$10^{11}$ Ω)" shoul dread --$10^{11}$ Ω--.

COLUMN 3,
Line 12, "In synchronous" should read --Synchronous--;
Line 45, "$I^Q$ = 15 μA" should read --$I_Q$ = 15 μA--; and
Line 46, "$I^T$ = 10 μA" should read --$I_T$ = 10 μA--; and COLUMN 4,
Line 3, "grounded" should be deleted; and
Line 4, "electrically." should read --electrically grounded--.

COLUMN 5,
Line 26, "$10^{13}$ Ωwere" should read --$10^{13}$ Ω were--;
Line 32, "Ωachieved" should read --Ω achieved--; and
Line 34, "Ω(test 1)," should read --Ω (test 1),--.

UNITED STATES PATENT AND TRADEMARK OFFICE

CERTIFICATE OF CORRECTION

PATENT NO. : 5,911,100

DATED : June 8, 1999

INVENTOR(S) : TAKASHI HASEGAWA, ET AL.

It is certified that error appears in the above-identified patent and that said Letters Patent is hereby corrected as shown below:

COLUMN 6,
Line 32, "2mm or more." should read --2mm.--; and
Line 37, "member." should read --sheet.--.

Signed and Sealed this
Fourth Day of January, 2000

*Attest:*

*Attesting Officer*

*Acting Commissioner of Patents and Trademarks*